US006273692B1

(12) United States Patent
Kitano et al.

(10) Patent No.: US 6,273,692 B1
(45) Date of Patent: Aug. 14, 2001

(54) SCROLL-TYPE COMPRESSOR

(75) Inventors: Norio Kitano, Fujioka; Satoru Saito, Takasaki; Shinichi Ohtake, Ashikaga, all of (JP)

(73) Assignee: Sanden Corporation, Gumma (JP)

( * ) Notice: Subject to any disclaimer, the term of this patent is extended or adjusted under 35 U.S.C. 154(b) by 0 days.

(21) Appl. No.: 09/604,292

(22) Filed: Jun. 26, 2000

(30) Foreign Application Priority Data

Jun. 29, 1999 (JP) ..... 11-183615

(51) Int. Cl.[7] ..... F03C 2/00
(52) U.S. Cl. ..... 418/55.3; 418/55.5; 418/57
(58) Field of Search ..... 418/55.3, 55.5, 418/57

(56) References Cited

U.S. PATENT DOCUMENTS

| | | | | |
|---|---|---|---|---|
| 4,580,956 | * | 4/1986 | Takahashi et al. | 418/55.5 |
| 4,824,346 | * | 4/1989 | Hiraga et al. | 418/55.5 |
| 4,892,469 | * | 1/1990 | McCullough et al. | 418/55.5 |
| 5,108,274 | * | 4/1992 | Kakuda et al. | 418/55.5 |
| 5,201,645 | * | 4/1993 | Steele | 418/55.5 |
| 5,536,152 | * | 7/1996 | Kawahara et al. | 418/55.5 |

FOREIGN PATENT DOCUMENTS

| | | | | |
|---|---|---|---|---|
| 56-129791 | * | 10/1981 | (JP) | 418/55.5 |
| 58-067903 | | 4/1983 | (JP) . | |
| 61-215481 | * | 9/1986 | (JP) | 418/55.5 |
| 2-115588 | * | 4/1990 | (JP) | 418/55.5 |
| 2-298685 | * | 12/1990 | (JP) | 418/55.5 |
| 2000161252 | * | 6/2000 | (JP) | 418/55.5 |
| 2000161253 | * | 6/2000 | (JP) | 418/55.5 |

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

A scroll-type compressor includes a fixed first scroll member, an orbital second scroll member, and a ball coupling provided as a rotation preventing mechanism for the second scroll member. The ball coupling has a pair of plates integrally formed with ring-like ball rolling grooves and a plurality of balls disposed therebetween. The compressor comprises a driven crank mechanism creating a swing motion for producing an orbital movement of the second scroll member. The amount of variation of the swing angle due to the driven crank mechanism is set within a range predetermined in accordance with a diameter of a ring form of each of the ring-like ball rolling grooves. The variation of the orbital radius of the orbital movement of the second scroll member corresponding to the swing angle may be regulated within a most appropriate range, thereby preventing occurrence of problems in the rotation preventing mechanism with respect to abrasion, performance and durability.

5 Claims, 4 Drawing Sheets

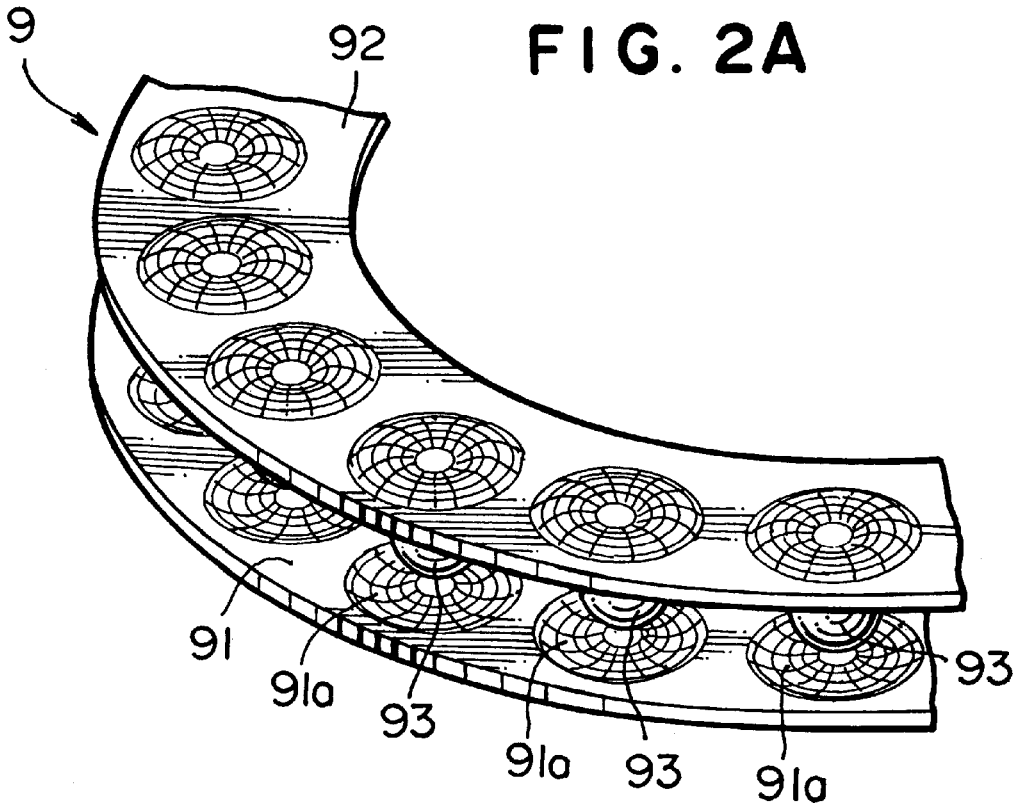
FIG. 2A
FIG. 2B
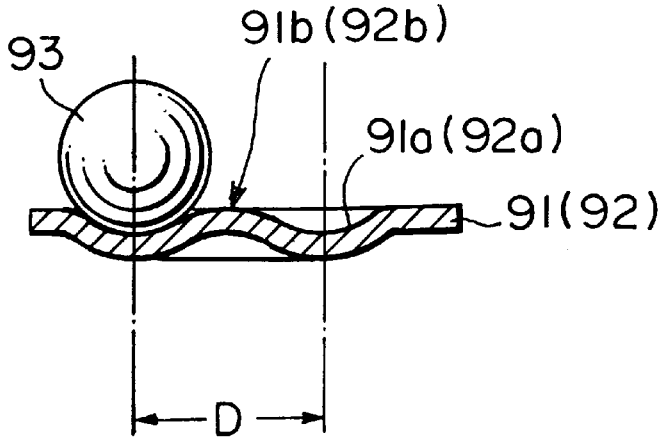

$\theta_1 > \theta_0$ $Rc_1 > Rc$ $\theta_2 < \theta_0$ $Rc_2 < Rc$

SCROLL-TYPE COMPRESSOR

BACKGROUND OF THE INVENTION

1. Field of the Invention

The present invention relates to a scroll-type compressor, and more specifically, to a crank mechanism of the scroll-type compressor.

2. Description of Related Art

In general, a scroll-type compressor includes a first scroll member and a second scroll member within a housing. The first scroll member is provided as a fixed scroll member. The second scroll member is provided as an orbital scroll member for nonrotatable, orbital movement relative to the first scroll member. The rotation of the second scroll member is prevented by a rotation preventing mechanism provided in the compressor. The first scroll member has a first end plate and a first spiral element which axially extends from the first end plate. The second scroll member has a second end plate and a second spiral element which axially extends from the second end plate. The first spiral element and the second spiral element interfit at an angular and radial offset to form a plurality of line contacts which define at least one pair of sealed-off fluid pockets. The sealed-off fluid pockets move radially inwards due to the nonrotatable, orbital movement of the second scroll member, and decrease in volume, thereby, compressing the fluid.

A ball coupling may be used as the rotation preventing mechanism for the second scroll member. A known ball coupling-type rotation preventing mechanism has a pair of plates and a plurality of balls disposed between the plates. The pair of plates have ring-like ball rolling grooves for receiving the balls on respective surfaces facing each other. One of the pair of plates is fixed to a front housing, and the other of the pair of plates is fixed to the second scroll member.

The second scroll member is driven by a drive mechanism. The drive mechanism is constructed, for example, as disclosed in JP-A 58-67903. The drive mechanism comprises a drive shaft, a crank pin provided eccentric to the drive shaft, and a driven crank mechanism, which is swingably fitted to the crank pin and rotatably held by the second scroll member. In such a drive mechanism, the driven crank mechanism is constructed so that the driven crank mechanism can be swung relative to the crank pin, and the radius of the orbital movement of the second scroll member is variable.

In the driven crank mechanism, each of the pair of plates may be formed as a plate integrally formed with the ring-like ball rolling grooves on its one surface. Hereinafter, such type plate is referred to as a "integrally formed plate".

In a known compressor, the swing angle of the driven crank mechanism is designed to be relatively large, regardless the structure of the plates of the rotation preventing mechanism. In a case where the integrally formed plates are employed for the rotation preventing mechanism, and the swing angle of the driven crank mechanism is designed relatively large, particularly when a clutch is turned on at a high speed condition, thereby starting to rotate a drive shaft, the balls are likely to roll on a central projection of a ring form of each ring-like ball rolling groove. In particular, in the driven crank mechanism, the radius of the second scroll member is likely to become smaller by an inertia of a counter weight forming the driven crank mechanism. In other words, the ball is likely to roll not along the bottom circle line of the ring-like ball rolling groove, but along a portion closer to the central projection of the ring form of the ring-like ball rolling groove. The force causing the ball to roll on the central projection becomes greater as the swing angle of the driven crank mechanism is designed to be larger. If the ball rolls on the central projection, abrasion of the ball or the plate, or both, may occur. Thus, if the swing angle of the driven crank mechanism is designed to be too large, a defect may occur on the rotation preventing mechanism.

The driven crank mechanism may have a swing angle variation allowing mechanism for maintaining a desired performance of the compressor by absorbing any dimensional variation of the scroll members. By this swing angle variation allowing mechanism, the second scroll member may be driven without departing from the first scroll member, in order to form desired sealed-off fluid pockets. However, if the allowable range of variation of the swing angle due to the swing angle variation allowing mechanism is too large, the swing angle of the driven crank mechanism itself may become too large. In such a condition, the above-described defect on the abrasion of the balls or the plates may occur.

On the contrary, if the allowable range of variation of the swing angle due to the swing angle variation allowing mechanism is too small, a variable range of the radius of the orbital movement of the second scroll member is suppressed too small, and the second scroll member may be hard to be driven along the first scroll member at a condition maintaining the necessary contact with the first scroll member. In such a condition, maintaining a desired performance of the compressor would be difficult.

Further, the swing angle variation allowing mechanism has a function for absorbing an excessive load due to excessive fluid compression or foreign material invasion. If the allowable range of variation of the swing angle due to the swing angle variation allowing mechanism is too small, the durability of the compressor to be ensured by the function of the swing angle variation allowing mechanism may decrease.

SUMMARY OF THE INVENTION

It is an object of the present invention to provide an improved structure for a scroll-type compressor, which can prevent a defect on a rotation preventing mechanism for the second scroll member without generating problems or a decrease in performance and durability of the compressor.

It is another object of the present invention to provide an improved structure for a scroll-type compressor which can facilitate the application of integrally formed plates to the rotation preventing mechanism.

To achieve the foregoing and other objects, a scroll-type compressor according to the present invention is herein provided. The scroll-type compressor includes a first scroll member and a second scroll member disposed for nonrotatable, orbital movement relative to the first scroll member, and a ball coupling provided as a rotation preventing mechanism for the second scroll member. The ball coupling has a pair of plates and a plurality of balls disposed between the plates. The pair of plates have ring-like ball rolling grooves for receiving the balls on respective surfaces facing each other. The compressor comprises a driven crank mechanism creating a swing motion for producing an orbital movement of the second scroll member. A swing angle of the driven crank mechanism corresponds to a radius of the orbital movement of the second scroll member. The driven crank mechanism has a swing angle variation allowing mechanism for regulating a maximum amount of variation of the swing angle. The maximum amount of variation of the swing angle due to the swing angle variation allowing mechanism is set within a range predetermined in accordance with a diameter of a ring form of each of the ring-like ball rolling grooves.

In the scroll-type compressor, each of the pair of plates of the ball coupling may be formed as a plate integrally formed with the ring-like ball rolling grooves on its one surface. The predetermined range is set within a range of from ±0.5° to ±1.5° relative to a variation center of the swing angle of the driven crank mechanism.

In a preferred embodiment, the scroll-type compressor includes a first scroll member having a first spiral element; a second scroll member disposed for nonrotatable, orbital movement relative to the first scroll member and having a second spiral element, the first and second spiral elements interfitting at an angular and radial offset to form a plurality of line contacts which define at least one pair of sealed-off fluid pockets; a ball coupling provided as a rotation preventing mechanism for the second scroll member and having a pair of plates and a plurality of balls disposed between the plates; and a driving mechanism for the second scroll member. The pair of plates have ring-like ball rolling grooves for receiving the balls on respective surfaces facing each other, one of the pair of plates is fixed to a front housing, and the other of the pair of plates is fixed to the second scroll member. The driving mechanism comprises a drive shaft, a crank pin provided eccentric to the drive shaft, and a driven crank mechanism being swingably fitted to the crank pin and being rotatably held by the second scroll member. The driven crank mechanism has a swing angle variation allowing mechanism for regulating a maximum amount of variation of a swing angle of the driven crank mechanism. The maximum amount of variation of the swing angle due to the swing angle variation allowing mechanism is set within a range predetermined in accordance with a diameter of a ring form of each of the ring-like ball rolling grooves, such that the balls are held within the ring-like ball rolling grooves during operation of the compressor.

In the scroll-type compressor according to the present invention, the amount of variation of the swing angle of the driven crank mechanism is regulated within a proper range by the swing angle variation allowing mechanism having a predetermined range that is adequately set in accordance with a diameter of a ring form of each of the ring-like ball rolling grooves. Because the swing angle of the driven crank mechanism corresponds to the radius of the orbital movement of the second scroll member, variation of the radius of the orbital movement also may be regulated within a proper range. Therefore, the swing angle may be prevented from becoming too large, and the allowable range of variation of the swing angle may be prevented from becoming too small. Consequently, the rolling of the ball on the center projection of a ring form of each ring-like ball rolling groove due to an excessive swing angle may be prevented, thereby preventing abrasion of the balls or the plates. This may facilitate use of integrally formed plates for the rotation preventing mechanism. A decrease in the performance and a decrease of the durability of the compressor due to a too small range of the allowable variation of the swing angle also may be prevented. Thus, the problems in the rotation preventing mechanism with respect to abrasion, performance and durability may be all solved.

Further objects, features, and advantages of the present invention will be understood from the following detailed description of a preferred embodiment of the present invention with reference to the accompanying figures.

BRIEF DESCRIPTION OF THE DRAWINGS

An embodiment of the invention is now described with reference to the accompanying figures, which are given by way of example only, and is not intended to limit the present invention.

FIG. 2A is an enlarged, partial perspective view of a ball coupling used in the scroll-type compressor depicted in FIG. 1.

FIG. 2B is an enlarged, partial sectional view of the ball coupling depicted in FIG. 2A.

DETAILED DESCRIPTION OF PREFERRED EMBODIMENTS

Figure 1:
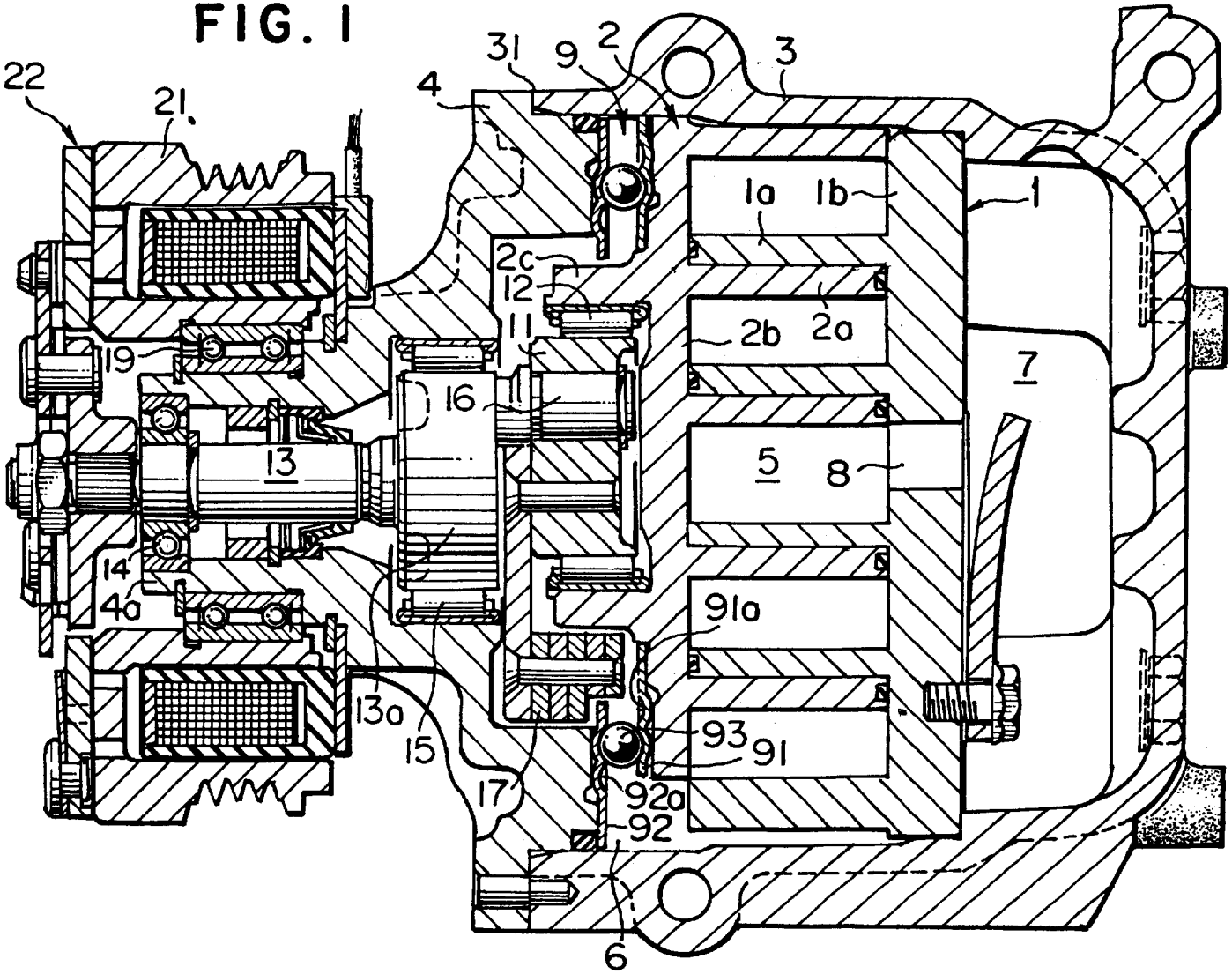
FIG. 1 is a vertical, cross-sectional view of a scroll-type compressor according to an embodiment of the present invention.

Referring to FIG. 1, a scroll-type compressor according to the present invention is provided. The illustrated scroll-type compressor is designed for use in an air conditioner for vehicles. The scroll-type compressor includes first scroll member 1, second scroll member 2 interfitted to first scroll member 1, housing 3 formed as a cup-like body and enclosing first scroll member 1 and second scroll member 2, and front housing 4 closing a front end of housing 3.

First scroll member 1 comprises first end plate 1*b*, and first spiral element 1*a*. First end plate 1*b* is formed as a circular plate. First spiral element 1*a* is formed along an involute curve. First spiral element 1*a* is provided on one surface of first end plate 1*b*, such that first spiral element 1*a* axially extends into the interior of housing 3. Second scroll member 2 comprises second end plate 2*b*, and second spiral element 2*a*. Second end plate 2*b* is formed as a circular plate. Second spiral element 2*a* is formed along the same involute curve as that of first spiral element 1*a*. Second spiral element 2*a* is provided on one surface of second end plate 2*b*, such that second spiral element 2*a* extends axially into the interior of housing 3. Second scroll member 2 is disposed for nonrotatable, orbital movement relative to first scroll member 1 within the interior of housing 3. First spiral element 1*a* of first scroll member 1 and second spiral element 2*a* of second scroll member 2 are interfitted at an angular and radial offset to form a plurality of line contacts, which define at least one pair of sealed-off fluid pockets 5 between first spiral element 1*a* and second spiral element 2*a*. Sealed-off fluid pockets 5 move radially inwards due to the nonrotatable, orbital movement of second scroll member 2, and decrease in volume, thereby, compressing the fluid.

First end plate 1*b* of first scroll member 1 is fixed to housing 3. Discharge chamber 7 is formed between first end plate 1*b* of first scroll member 1 and the inner surface of housing 3. Discharge port 8 is formed on first end plate 1*b* at the central portion of first end plate 1*b*. Fluid is sucked from suction chamber 6 into fluid pockets 5, compressed in fluid pockets 5 as a result of the movement of fluid pockets 5 in a radially inward direction, and the compressed fluid is then discharged into discharge chamber 7 through discharge port 8.

Rotation preventing mechanism 9 is provided between the outer surface of second end plate 2*b* of second scroll member 2 and the inner surface of front housing 4. Rotation preventing mechanism 9 prevents the rotation of second scroll member 2 with respect to first scroll member 1, when second scroll member 2 moves in an orbital motion at a predetermined orbital radius around a center axis of first scroll member 1. Rotation preventing mechanism 9 will be described in greater detail below.

Ring-like projected portion 2*c* is provided on the surface of second end plate 2*b* of second scroll member 2 opposite to the surface of second spiral element 2*a*. Eccentric bush 11 is rotatably disposed in projected portion 2*c* via drive bearing 12. Eccentric bush 11 forms a driven crank mechanism.

Drive shaft 13, having a large diameter portion 13*a*, is disposed at a central position of front housing 4. Drive shaft 13 is rotatably supported by shaft bearing 14, and its large diameter portion 13*a* is rotatably supported by main bearing 15. Large diameter portion 13*a* of drive shaft 13 has eccentric pin 16 that engages eccentric bush 11. Counter weight 17 is provided to eccentric bush 11 at a position opposite to the position of eccentric pin 16 for balancing with the centrifugal force during the operation of second scroll member 2. Eccentric pin 16 is provided as a crank pin of the driven crank mechanism. Eccentric bush 11 can swing around eccentric pin 16, and this swing mechanism achieves the orbital movement of second scroll member 2 and the variable orbital radius of the orbital movement.

Rotor 21 is rotatably supported on the outer surface of cylindrical portion 4*a* of front housing 4 via radial bearing 19. Rotor 21 is driven, for example, by an engine of a vehicle. Rotor 21 is connected to drive shaft 13 via electromagnetic clutch 22. When electromagnetic clutch 22 is turned on, shaft 13 rotates together with rotor 21. When electromagnetic clutch 22 is turned off, shaft 13 is separated from rotor 21.

When shaft 13 rotates, second scroll member 2 is driven in an orbital movement by the cooperation of the engaging mechanism of eccentric pin 16 and eccentric bush 11 and rotation preventing mechanism 9. At that time, the rotation of second scroll member 2 is prevented by rotation preventing mechanism 9.

Consequently, fluid pockets 5 move radially inward and compress the fluid therein, and the compressed fluid is discharged into discharge chamber 7 through discharge port 8. The compressed fluid in discharge chamber 7 is sent to a refrigerating circuit, and the circulated fluid in the refrigerating circuit is then returned to suction chamber 6.

Next, rotation preventing mechanism 9 will be explained in more detail, referring also to FIGS. 2A and 2B.

Rotation preventing mechanism 9 is generally called a "ball coupling." Ball coupling 9 comprises a pair of plates 91 and 92, and a plurality of metal balls 93 interposed between plates 91 and 92. Each of plates 91 and 92 is made from a material having a high elasticity. Each of plates 91 and 92 is formed as an integrally formed plate. One plate 91 is fixed to second scroll member 2. The other plate 92 is fixed to front housing 4. A plurality of ball rolling grooves 91*a* and 92*a* are provided, on the respective surfaces of plates 91 and 92, facing each other. Ball rolling grooves 91*a* and 92*a* are disposed in the circumferential directions about the respective plates 91 and 92. Each of ball rolling grooves 91*a* and 92*a* is formed as a ring-like groove having center projection 91*b* or 92*b*. The diameters D of ball rolling grooves 91*a* and 92*a* are the same. The diameter D of ball rolling grooves 91*a* and 92*a* corresponds to an orbital radius of the orbital movement of second scroll member 2. Each ball 93 is interposed between the corresponding ball rolling grooves 91*a* and 92*a* formed at substantially the same circumferential position. Each ball 93 rolls along ball rolling grooves 91*a* and 92*a* during the operation of the compressor. Such a rotation preventing mechanism formed as ball coupling 9 with integrally formed plates 91 and 92 and balls 93 has the advantage of requiring a small number of parts. On the other hand, it has a problem that the behavior of balls 93 may not be stable, as described before.

Accordingly, in the present invention, a swing angle variation allowing (regulating) mechanism is provided for regulating a maximum amount of variation in the swing angle of eccentric bush 11 within a range that is predetermined in accordance with diameter D of the ring form of ball rolling grooves 91*a* and 92*a*.

Figure 3:
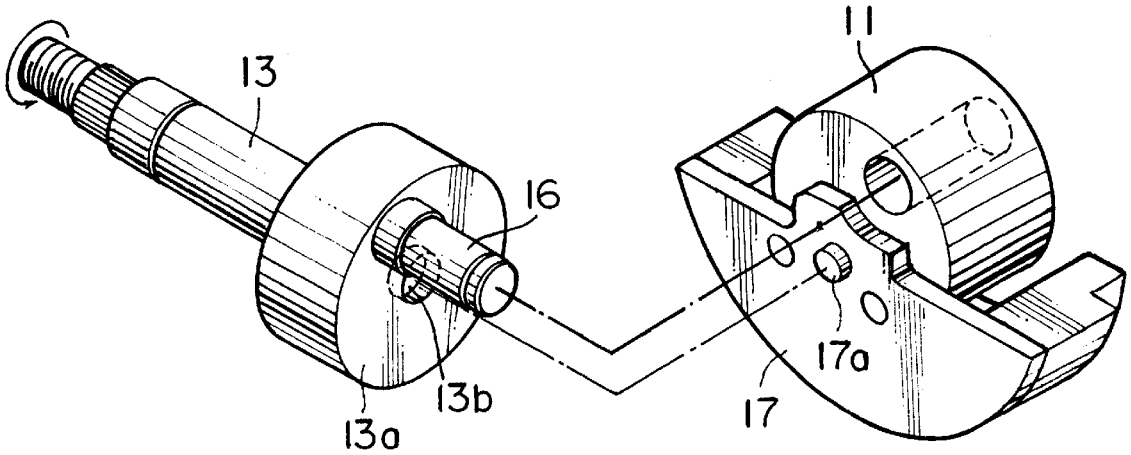
FIG. 3 is an exploded, partial perspective view of a drive shaft and a driven crank mechanism used in the scroll-type compressor depicted in FIG. 1.
Figure 4:
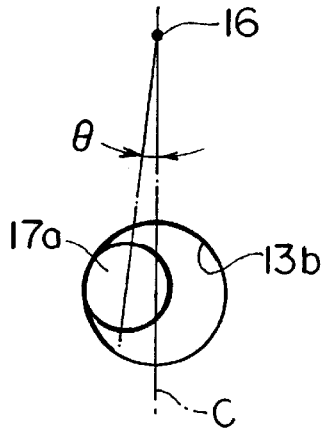
FIG. 4 is a schematic view for explanation of variation of a swing angle in the scroll-type compressor depicted in FIG. 1.

Referring to FIG. 3, regulation hole 13*b* is defined on the axial end surface of large diameter portion 13*a* of drive shaft 13. Regulating projection 17*a* is provided on the axial end surface of counter weight 17. Regulating projection 17*a* has a diameter smaller than the inner diameter of regulation hole 13*b*. Regulating projection 17*a* is inserted into regulation hole 13*b* with a gap when the scroll-type compressor is assembled. In the assembly, as depicted in FIG. 4, the dimensions and the positions of regulating projection 17*a* and regulation hole 13*b* are designed so that regulating projection 17*a* can be swung in regulation hole 13*b* around the center of eccentric pin 16, which forms a center of the swing. Allowable maximum swing angle θ from swing center C may be predetermined as a proper angle determined from experimental data. The maximum amount θ of variation of the swing angle due to such a swing angle variation allowing mechanism may be set within a range of from ±0.5° to ±1.5° relative to variation center C of the swing angle of eccentric bush 11. Thus, the allowable amount of variation of the swing angle of eccentric bush 11 is set, and the amount of the variation is regulated within the predetermined range θ.

Figure 5A:
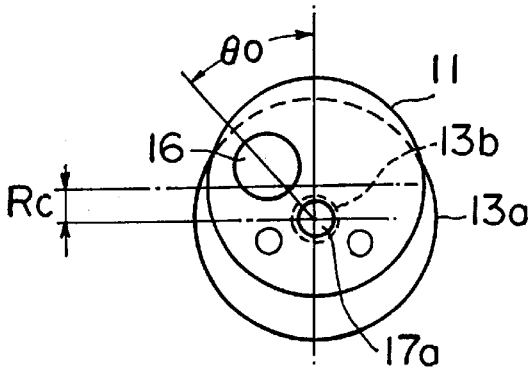
FIGS. 5A–5C are schematic elevational views of the driven crank mechanism and a crank pin of the scroll-type compressor depicted in FIG. 1, showing variable swing angles of the driven crank mechanism and orbital radii of a second scroll member in respective operative conditions.

FIG. 5A depicts a normal rotation condition of the compressor. In this condition, radius Rc of the orbital movement of second scroll member 2 is determined as a radius nearly equal to a standard orbital radius decided by the dimensions of first scroll member 1 and second scroll member 2. Radius Rc is determined as a distance between the center of eccentric bush 11 and the center of regulation hole 13*b*. In this condition, the center of regulating projection 17*a* is positioned almost at the center of regulation hole 13*b* to create swing angle $\theta_0$.

Figure 5B:
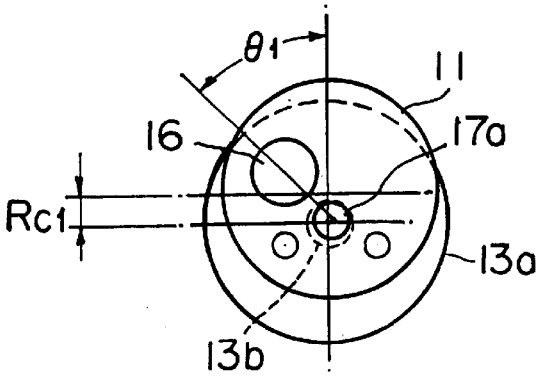

FIG. 5B depicts a condition of an increased orbital radius. Orbital radius $Rc_1$ is greater than standard orbital radius Rc. Radius $Rc_1$ is determined as a distance between the center of eccentric bush 11 slightly swung upward and obliquely around crank pin 16 and the center of regulation hole 13*b*. In this condition, the center of regulating projection 17*a* is positioned higher than the center of regulation hole 13*b* to create swing angle $\theta_1$, which is greater than swing angle $\theta_0$.

Figure 5C:
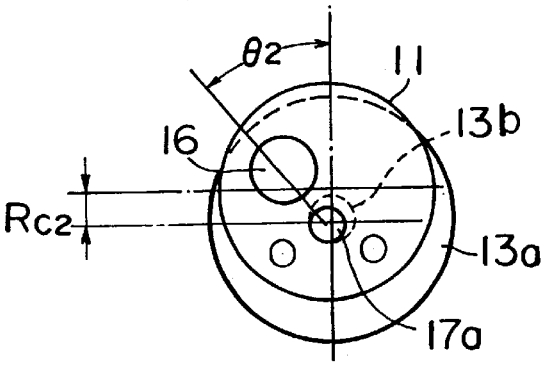

FIG. 5C depicts a condition of an decreased orbital radius. Orbital radius $Rc_2$ is smaller than standard orbital radius Rc. Radius $Rc_2$ is determined as a distance between the center of eccentric bush 11 slightly swung downward and obliquely around crank pin 16 and the center of regulation hole 13*b*. In this condition, the center of regulating projection 17*a* is positioned lower than the center of regulation hole 13*b* to create swing angle $\theta_2$, that is smaller than swing angle $\theta_0$.

Thus, the variation of the swing angle is regulated within a predetermined proper range, that is determined by $\theta_1-\theta_0$ or $\theta_0-\theta_2$. This predetermined proper range is designed as a range that is not too great nor too small, thereby preventing occurrence of the problems in the rotation preventing mechanism with respect to abrasion, performance and durability.

Although regulating projection 17*a* is provided on the side of eccentric bush 11 and regulation hole 13*b* is defined on the side of large diameter portion 13*a* of drive shaft 13 in the above-described embodiment, the projection and hole may be provided on the other parts.

Although only one embodiment of the present invention has been described in detail herein, the scope of the invention is not limited thereto. It will be appreciated by those skilled in the art that various modifications may be made without departing from the scope of the invention. Accordingly, the embodiment disclosed herein is only exemplary. It is to be understood that the scope of the invention is not to be limited thereby, but is to be determined by the claims which follow.

What is claimed is:

1. A scroll-type compressor including a first scroll member and a second scroll member disposed for nonrotatable, orbital movement relative to said first scroll member, and a ball coupling provided as a rotation preventing mechanism for said second scroll member and having a pair of plates and a plurality of balls disposed between said plates, said pair of plates having ring-like ball rolling grooves for receiving said balls on respective surfaces facing each other, said compressor comprising:

a driven crank mechanism creating a swing motion for producing an orbital movement of said second scroll member, a swing angle of said driven crank mechanism corresponding to a radius of said orbital movement of said second scroll member, said driven crank mechanism having a swing angle variation allowing mechanism for regulating a maximum amount of variation of said swing angle, said maximum amount of variation of said swing angle due to said swing angle variation allowing mechanism being set within a range predetermined in accordance with a diameter of a ring form of each of said ring-like ball rolling grooves.

2. The scroll-type compressor of claim 1, wherein each of said pair of plates of said ball coupling is formed as a plate integrally formed with said ring-like ball rolling grooves on its one surface.

3. The scroll-type compressor of claim 2, wherein said predetermined range is set within a range of from ±0.5° to ±1.5° relative to a variation center of said swing angle of said driven crank mechanism.

4. The scroll-type compressor of claim 1, wherein said predetermined range is set within a range of from ±0.5° to ±1.5° relative to a variation center of said swing angle of said driven crank mechanism.

5. A scroll-type compressor comprising:

a first scroll member having a first spiral element;

a second scroll member disposed for nonrotatable, orbital movement relative to said first scroll member and having a second spiral element, said first and second spiral elements interfitting at an angular and radial offset to make a plurality of line contacts which define at least one pair of sealed-off fluid pockets;

a ball coupling provided as a rotation preventing mechanism for said second scroll member and having a pair of plates and a plurality of balls disposed between said plates, said pair of plates having ring-like ball rolling grooves for receiving said balls on respective surfaces facing each other, one of said pair of plates being fixed to a front housing, the other of said pair of plates being fixed to said second scroll member; and a driving mechanism for said second scroll member comprising a drive shaft, a crank pin provided eccentric to said drive shaft, and a driven crank mechanism being swingably fitted to said crank pin and being rotatably held by said second scroll member, said driven crank mechanism having a swing angle variation allowing mechanism for regulating a maximum amount of variation of a swing angle of said driven crank mechanism, said maximum amount of variation of said swing angle due to said swing angle variation allowing mechanism being set within a range predetermined in accordance with a diameter of a ring form of each of said ring-like ball rolling grooves, such that said balls are held within said ring-like ball rolling grooves during operation of said compressor.

* * * * *